US011787626B2

(12) United States Patent
Kohen

(10) Patent No.: US 11,787,626 B2
(45) Date of Patent: Oct. 17, 2023

(54) FLEXIBLE BIG BAG EMBODIMENT PREVENTING WAVE

(71) Applicant: LIKUA ENDUSTRIYEL AMBALAJ MALZM. SAN. VE TIC. LTD. STI, Cekmekoy/Istanbul (TR)

(72) Inventor: Yusuf Kohen, Cekmekoy/Istanbul (TR)

(73) Assignee: LIKUA ENDUSTRIYEL AMBALAJ MALZM. SAN. VE TIC. LTD. STI, Istanbul (TR)

( * ) Notice: Subject to any disclaimer, the term of this patent is extended or adjusted under 35 U.S.C. 154(b) by 1066 days.

(21) Appl. No.: 16/325,941

(22) PCT Filed: Aug. 2, 2017

(86) PCT No.: PCT/TR2017/050363
§ 371 (c)(1),
(2) Date: Feb. 15, 2019

(87) PCT Pub. No.: WO2018/070954
PCT Pub. Date: Apr. 19, 2018

(65) Prior Publication Data

US 2021/0284437 A1 Sep. 16, 2021

(30) Foreign Application Priority Data

Aug. 17, 2016 (TR) ..... 2016/11603

(51) Int. Cl.
*B65D 88/16* (2006.01)
*B65D 90/52* (2006.01)
*B65D 88/22* (2006.01)

(52) U.S. Cl.
CPC ..... *B65D 90/52* (2013.01); *B65D 88/1606* (2013.01); *B65D 88/22* (2013.01)

(58) Field of Classification Search
CPC ..... B65D 88/1606; B65D 88/1612; B65D 88/1618; B65D 88/1625; B65D 88/1631; B65D 88/1637; B65D 88/1643; B65D 88/165; B65D 88/1656; B65D 88/1662; B65D 88/1668; B65D 88/1675;
(Continued)

(56) References Cited

U.S. PATENT DOCUMENTS 6,186,713 B1 * 2/2001 Bonerb ..... B60P 3/426 410/97
9,452,880 B2 * 9/2016 Thomas ..... B65D 88/1606
2011/0240652 A1 * 10/2011 Kohen ..... B65D 88/16 220/501

FOREIGN PATENT DOCUMENTS

DE 103 61 603 A1 7/2005
DE 20 2007 006 530 U1 9/2008
(Continued)

OTHER PUBLICATIONS

DE10361603Translation (Year: 2005).*
(Continued)

*Primary Examiner* — Jes F Pascua
*Assistant Examiner* — Nina K Attel
(74) *Attorney, Agent, or Firm* — Bayramoglu Law Offices LLC

(57) ABSTRACT

The present invention relates to a flexible big bag (10) provided for carrying liquid or liquid based material, stored therein, in a vehicle chassis or in a container, and having a first layer (101) which defines a closed volume.

10 Claims, 2 Drawing Sheets

(58) Field of Classification Search
CPC ..... B65D 88/1661; B65D 88/1687; B65D 88/1693; B65D 90/52; B65D 88/16–24
USPC ..... 220/501, 562–564; 383/116
See application file for complete search history.

(56) References Cited

FOREIGN PATENT DOCUMENTS

| | | |
|---|---|---|
| WO | 2008/109951 A1 | 9/2008 |
| WO | 2010/056219 A2 | 5/2010 |

OTHER PUBLICATIONS

International Search Report and Written Opinion of the International Searching Authority for International Patent Application No. PCT/TR2017/050363 dated May 7, 2018, 9 pages.

* cited by examiner

FLEXIBLE BIG BAG EMBODIMENT PREVENTING WAVE

CROSS-REFERENCE TO RELATED APPLICATIONS

This application is a National Stage Application of PCT/TR2017/050363, filed 2 Aug. 2017, which claims the benefit of Serial No. 2016/11603, filed 17 Aug. 2016 in Turkey, and which applications are incorporated herein by reference. To the extent appropriate, a claim of priority is made to each of the above-disclosed applications.

TECHNICAL FIELD

The present invention relates to a flexible big bag provided for carrying liquid or liquid based material, stored therein, in a vehicle chassis or in a container and having a first layer defining a closed volume.

PRIOR ART

Flexible big bags are used for carrying liquid or liquid-based materials. The vehicles, which carry the full flexible big bag generally between two locations, are truck-type land vehicles. Liquid waves occur in the full flexible big bags due to culverts or road conditions like deteriorations on the road or due to acceleration of the vehicle. While the vehicle is moving, when the liquid flows forwardly, it begins to rise and the potential energy gained during the rise increases exponentially during its return, and it forms a hydrodynamic load. Said hydrodynamic load may damage the seaming regions of the components forming the flexible big bag. Said seaming regions may be subject to intense tensioning and the flexible big bag may be separated into pieces through the seaming regions. This leads to loss of the liquid. Even if the flexible big bag is robust and it is not torn, driving safety may be compromised since high rate of yawing occurs. As a solution to this problem, some wave preventing flexible big bag embodiments are provided.

A flexible big bag, for carrying liquid or liquid based material, is placed to the vehicle chassis or to a container horizontally, and it is connected to the chassis and container through various regions. The force, created by the liquid based material, acts on the base and the material flow substantially continues on the base side. An unbalanced material flow occurs due to this. Even if binding items form wave breakers which appear as compartment, the binding items cannot completely prevent agitation.

In the utility model with number 2008/08670, a wave preventing flexible big bag for carrying liquid or liquid based materials is disclosed. Said flexible big bag comprises pluralities of compartments connected to each other in a manner comprising a curved form. There are openings which permit liquid passage between the compartments. In the utility model with number 2007/00090, a flexible tank is disclosed which can store liquid therein. The flexible tank has pluralities of compartments provided in a manner permitting liquid passage between at least two of said compartments. In said flexible tanks, the passage surfaces between the compartments are obtained by means of welding the compartments and by means of forming gaps on the welding surfaces. In flexible tanks, the compartments are separate items and they are connected to each other. The joining and welding process leads to labor force difficulty, and risks occur in production and in the product. In these applications, a serious labor force loss occurs for said flexible tanks.

In the present art, even if flexible big bags have been developed for preventing wave formation, a solution is not present where wave formation risk is completely prevented and where labor is reduced, and thus, an improvement is required in the related technical field.

BRIEF DESCRIPTION OF THE INVENTION

The object of the present invention is to provide a flexible big bag where the wave movement of the liquid based material, carried therein, is prevented.

Another object of the present invention is to prevent wave formation for flexible big bags carrying liquid based material and to reduce production labor.

In order to realize all of the abovementioned objects and the objects which are to be deducted from the detailed description below, the present invention is a flexible big bag provided for carrying liquid or liquid based material, stored therein, in a vehicle chassis or in a container and having a first layer which defines a closed volume. Accordingly, there is at least one throttle region configured in a manner narrowing the cross sectional area of the first layer in the direction of the height of the first layer.

In a preferred embodiment of the invention, a ring section is provided in a manner encircling the circumference in the direction of the height of the first layer and which forms the throttle region and which has a circumference length smaller than the circumference length of the first layer.

In a preferred embodiment of the invention, at least one seaming region is provided which joins the sections where the first layer is folded in the throttle region.

In a preferred embodiment of the invention, a second layer is provided at the inner side of the first layer.

In a preferred embodiment of the invention, the first layer is made of plastic based material.

In a preferred embodiment of the invention, the first layer is made of a flexible and narrow woven material.

In a preferred embodiment of the invention, the second layer is made of a plastic-based material.

In a preferred embodiment of the invention, a protective layer is provided in a manner encircling in the vicinity of the throttle region in the direction of the height of the second layer. Thus, since the throttle region narrows the circumference of the first layer, the wrinkled second layer is prevented from being damaged.

In a preferred embodiment of the invention, a protective layer width of the protective layer is greater than a ring section width of the ring section.

In a preferred embodiment of the invention, the protective layer width is between 90 cm and 110 cm.

In a preferred embodiment of the invention, the protective layer width is 100 cm.

In a preferred embodiment of the invention, the protective layer material is selected from adhesive band and derivatives.

In a preferred embodiment of the invention, pluralities of throttle regions are provided in intervals pre-calculated on the first layer.

In a preferred embodiment of the invention, the circumferential length of the ring section is less than half of the circumferential length of the first layer.

In a preferred embodiment of the invention, the circumferential length of the ring section is greater than half of the circumferential length of the first layer and it is smaller than the whole of the circumferential length of the first layer.

In a preferred embodiment of the invention, the ring section is made of a flexible and narrow woven material.

In a preferred embodiment of the invention, the ring section is made of a rigid or semi-flexible material.

In a preferred embodiment of the invention, the ring section is made of polypropylene woven material.

In a preferred embodiment of the invention, the ring section width of the ring section is between 5 and 10 cm.

In a preferred embodiment of the invention, the ring section width is 5 cm.

In a preferred embodiment of the invention, the ring section is provided in a free manner at the circumference of the first layer.

In a preferred embodiment of the invention, the ring section is connected to the first layer.

In a preferred embodiment of the invention, the ring section is seamed to a region of the first layer.

In a preferred embodiment of the invention, the ring section is provided in a manner shrinking all periphery of the first layer in the same proportion. Thus, the flow, which continues at the base side by means of the force created by the weight of the liquid-based material, is guided upwardly since the base of the flexible tank is shrank, and wave breaking effect is created.

In a preferred embodiment of the invention, the seaming region is provided in a manner shrinking all periphery of the first layer in the same proportion. Thus, as in the ring section, the flow, which continues at the base side by means of the force created by the weight of the liquid-based material, is guided upwardly since the base of the flexible tank is shrank, and wave breaking effect is created.

DETAILED DESCRIPTION OF THE INVENTION

Figure 1A:
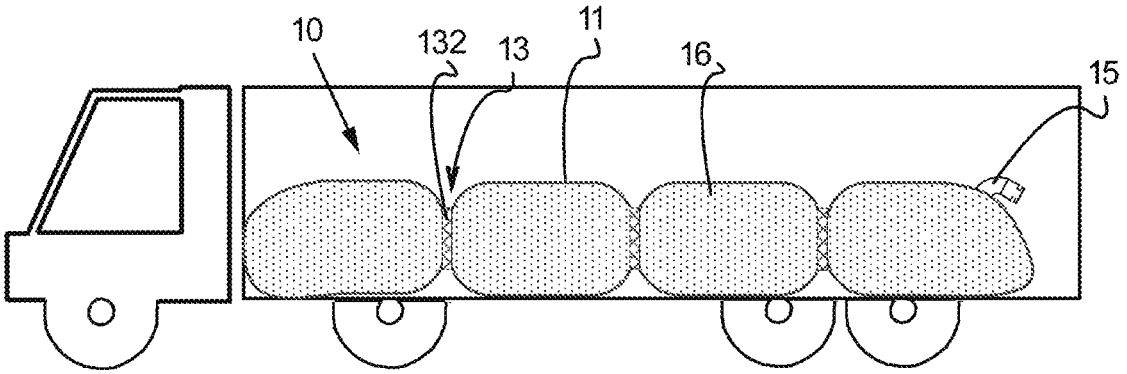
In FIG. 1*a*, the lateral view of the placed form of the subject matter flexible big bag to a vehicle chassis is given.

In this detailed description, the subject matter flexible big bag (10) is explained with references to examples without forming any restrictive effect only in order to make the subject more understandable.

In order to carry liquid or liquid-based material, a flexible big bag (10) essentially has a first layer (11) which defines a closed volume and wherein essentially the material to be carried is put. The flexible big bag (10) is provided in a form extending horizontally. The flexible big bag (10) has a valve (15) provided on the first layer (11). The process of liquid filling into and discharging from the flexible big bag (10) is realized by means of said valve (15). In the direction of the height of the first layer (11), at least one throttle region (13) is configured in a manner narrowing the cross section of the first layer (11). In the preferred application, pluralities of throttle regions (13) are provided on the first layer (11) at pre-calculated intervals. Various embodiments are provided in relation to formation of throttle region (13) on the first layer (11).

Figure 1B:
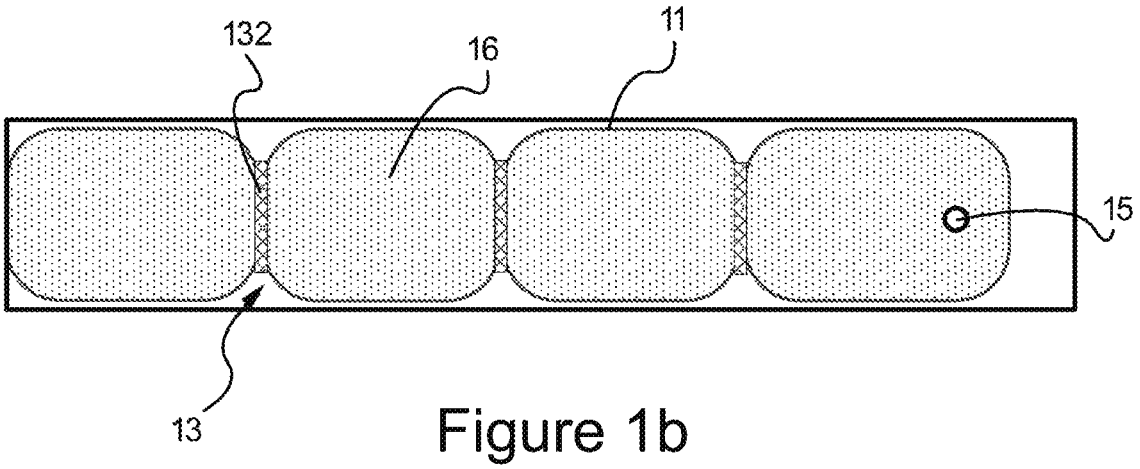
In FIG. 1*b*, a top representative view of the flexible big bag is given.

With reference to FIGS. 1*a* and 1*b*, there is a ring section (132) provided in a manner encircling the circumference in the direction of the height of the first layer (11) and which forms the throttle region (13) and having a circumference length which is smaller than the length of the circumference length of the first layer (11). The circumference length of the ring section (132) is smaller than the circumference length of the first layer (11). In one of the applications, the circumference length of the ring section (132) is embodied so as to be smaller than the half of the circumference length of the first layer (11). The ring section (132) is made of a narrow woven material which is flexible and which has high resistance. In the preferred application, the material of the ring section (132) is polypropylene woven material. In an alternative application, the ring section (132) can also be made of a rigid or semi-flexible material. The ring section width (W1) is provided between 5 and 10 cm. In the preferred application, the ring section width (W1) is embodied as 5 cm. The ring section (132) throttles specific sections of the first layer (11) and it forms pluralities of carrying compartments (16) inside the flexible big bag (10). Liquid material passage occurs between the carrying compartments (16). The ring sections (132) stay in a free manner after being placed to the circumference of the first layer (11). In other words, there is no connection of the ring section (132) to the first layer (11). In an alternative application, the ring section (132) is connected to the first layer (11). The connection of the ring section (132) to the first layer (11) can be realized by means of seaming. The sections where the ring section (132) throttles the first layer (11) are defined as the throttle region (13). The ring section (132) is provided in a manner shrinking all circumference of the first layer (11) in the same proportion in the direction of the height of the first layer (11). In other words, the ring section (132) throttles both the upper section of the first layer (11) and the section thereof which faces the vehicle chassis or the container, wherein it is carried, in a balanced manner. In this embodiment, the first layer (11) is embodied to be made of plastic-based material. Plastic based material is particularly thermoplastic material. The first layer (11) is particularly made of polyethylene material (PE). In an alternative application of the embodiment, the first layer (11) is made of nylon material. In this embodiment, the first layer (11) is provided at a predetermined thickness and a single layer is sufficient. In the preferred application, the first layer (11) is provided in approximately 1000 micron thickness in a stand-alone manner.

Figure 2:
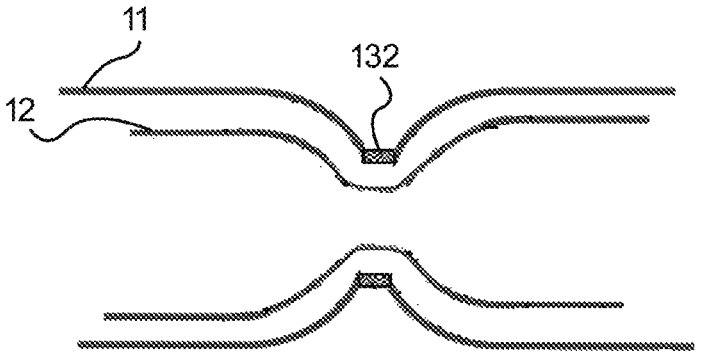
In FIGS. 2, 3*a* and 3*b*, the detailed views of the alternative embodiments of the flexible big bag are given.

With reference to FIG. 2, in a second embodiment, a second layer (12) is provided at the inner section of the first layer (11) whereon the ring section (132) is provided. In this embodiment, the first layer (11) is made of a flexible narrow woven material. In the preferred application, the material whereof said first material (11) is made is polypropylene woven. The first layer (11) can also be made of PVC and awning materials. PVC can be single-layer or multi-layer composite material. The second layer (12) is embodied to be made of plastic-based material. The plastic-based material is particularly thermoplastic material. The second layer (12) is particularly made of polyethylene material (PE). In an alternative application of the embodiment, the second layer (12) is made of nylon material.

Figure 4:
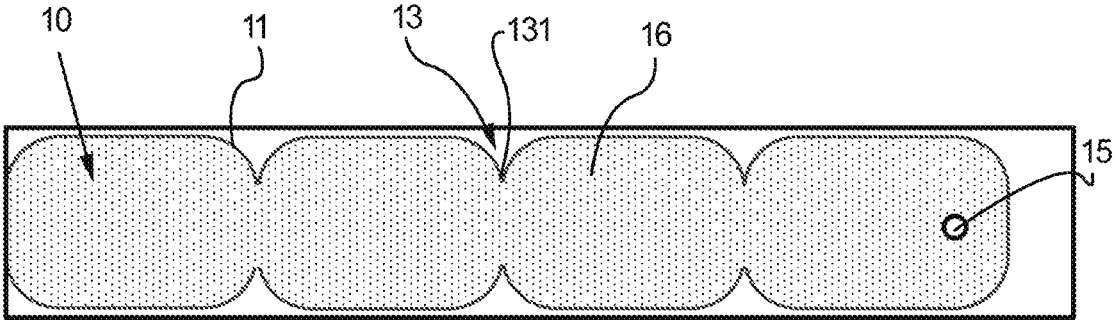
In FIG. 4, a top view of another alternative embodiment of the flexible big bag is given.

With reference to FIG. 4, also in a third embodiment, there is a second layer (12) provided at the inner section of the first layer (11). The material of the first layer (11) and the material of the second layer (12) are the same as or similar to the material of the second embodiment. The first layer (11) is brought into a form which is throttled at specific intervals from the circumference beforehand, and the flexible big bag (10) is formed in a manner encircling the second layer (12). Throttle regions (13) are formed which are configured in a manner narrowing the cross sectional area of the first layer (11). In the throttle regions (13), there is at least one seaming region (131) which joins the sections where the first layer (11) is folded. In the preferred application, the first layer (11) has seaming regions (131) along the whole circumference in the direction of the height of the first layer (11).

Figure 3A:
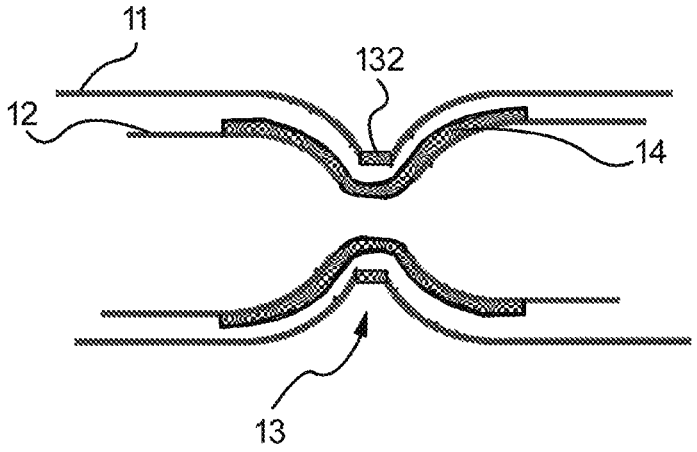
Figure 3B:
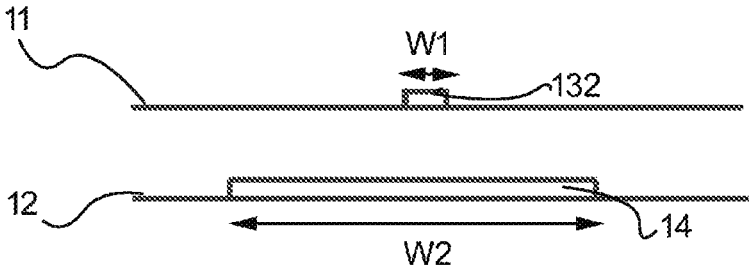

In the second and in the third embodiment, as the first layer (11) is throttled, the sections of the second layer (12), provided in the vicinity of the throttle region (13), are shrank. With reference to FIG. 3*a*, a protective layer (14) is provided on the second layer (12) when required in accordance with the material whereof the second layer (12) is made. The protective layer (14) is positioned in a manner covering the throttle region (13). The protective layer (14) is provided in a manner encircling the second layer (12) in the vicinity of the throttle region (13) on the face of the second layer (12) facing the first layer (11). With reference to FIG. 3*b*, since the throttle process on the second layer (12) affects in a wider area than the first layer (11), the protective layer width (W2) of the protective layer (14) is adjusted to be greater than the ring section width (W1). The protective layer width (W2) can be provided between 90 cm and 110 cm. In the preferred application, a protective layer (14), whose protective layer width (W2) is 100 cm, is connected onto the second layer (12) in a manner encircling the second layer (12) in the direction of the height of the second layer (12). As the protective layer (14), a material is used whose tearing resistance is high and which can be connected to the second layer (12). Preferably as the protective layer (14) and as adhesive band and derivatives; adhesive band, reinforced adhesive band are used. The protective layer (14) is adhered in a manner encircling the second layer (12) at the determined width. Moreover, any protective layer (14) can be adhered onto the surface of the second layer (12) by means of double-sided adhesive band or by means of a suitable adhesive. Since protective layer (14) is provided on the second layer (12), the second layer (12) is protected from a tear which is sourced from a probable shrinking. If the material of the second layer (12) does not lead to tearing problem due to the throttle process of the ring section (132), there remains no need to use the protective layer (14).

In the light of the structural details given above, the operation of the invention is as follows. The flexible big bag (10), wherein liquid or liquid based material is filled, is placed to the chassis of a truck-type vehicle or to a container. The flexible big bag (10) can be fixed into the container or into the vehicle chassis. In an alternative application, the flexible big bag (10) is left in a free manner in the vehicle chassis or in the container. By means of the movement of the vehicle, the material provided in the flexible big bag (10) can also be moved in the accelerated movements or in vehicle shakes. The liquid material flows forwardly and begins rising, and the potential energy gained after rising increases exponentially in the return, and the potential energy forms hydrodynamic load. Throttle regions (13) are provided on the first layer (11), and the hydrodynamic load, formed by having carrying compartments (16), returns in a balanced manner, and thanks to the narrowing in the bottle mouth form provided by the throttle regions (13), and the hydrodynamic load is dampened and a balanced wave breaking characteristic is formed. Since throttle regions (13) are formed in the whole circumference of the first layer (11), breaking of the wave is provided in a balanced manner. Since the force, created by the weight of the liquid-based material, acts on the base, the flow which continues on the base side is guided upwardly and wave breaking effect is increased since the base of the flexible big bag (10) is also shrank. Thus, liquid flow is balanced. When the wave formation is prevented or when the wave is broken, the damages like tearing of the seaming sections of the flexible big bag (10) are prevented and driving safety is provided. Moreover, formation of the throttle region (13) by means of interfering to a single layer of the single-piece flexible big bag (10) instead of the methods of joining carrying compartments substantially reduces the labor force proportion.

The protection scope of the present invention is set forth in the annexed Claims and cannot be restricted to the illustrative disclosures given above, under the detailed description. It is because a person skilled in the relevant art can obviously produce similar embodiments under the light of the foregoing disclosures, without departing from the main principles of the present invention.

REFERENCE NUMBERS

10 Flexible big bag
11 First layer
12 Second layer
13 Throttle region
131 Seaming region
132 Ring section
14 Protective layer
15 Valve
16 Carrying compartment
W1: Ring section width
W2: Protective layer width

The invention claimed is:

1. A flexible big bag (10) provided for carrying liquid or liquid based material stored therein, in a vehicle chassis or in a container, and having a first layer (11) which defines a closed volume, characterized by comprising:

at least one throttle region (13) configured in a manner narrowing a cross sectional area of the closed volume in a direction of a height of the flexible big bag (10);

a ring section (132) provided in a manner encircling a circumference of the first layer and which forms the at least one throttle region (13) and which has a circumference length smaller than a circumference length of the first layer (11);

a second layer (12) provided at an inner side of the first layer (11);

a protective layer (14) provided in a manner encircling the second layer (12) in a vicinity of the at least one throttle region (13) and on a face of the second layer (12) facing the first layer (11).

2. The flexible big bag according to claim 1, wherein a protective layer width (W2) of the protective layer (14) is greater than a ring section width (W1) of the ring section (132).

3. The flexible big bag according to claim 1, wherein the at least one throttle region comprises a plurality of throttle regions (13) provided in intervals pre-calculated on the first layer (11).

4. The flexible big bag according to claim 1, wherein the circumferential length of the ring section (132) is less than half of the circumferential length of the first layer (11).

5. The flexible big bag according to claim 1, wherein the circumference length of the ring section (132) is greater than half of the circumference length of the first layer (11).

6. The flexible big bag according to claim 1, wherein the ring section (132) is provided in a free manner at the circumference of the first layer (11).

7. The flexible big bag according to claim 1, wherein the ring section (132) is connected to the first layer (11).

8. The flexible big bag according to claim 7, wherein the ring section (132) is seamed to a region of the first layer (11).

9. The flexible big bag according to claim 1, wherein the ring section (132) is provided in a manner shrinking all periphery of the first layer (11) in the same proportion.

10. The flexible big bag according to claim 1, wherein the protective layer (14) covers the throttle region (13).

* * * * *